US006405383B2

(12) United States Patent
Heller et al.

(10) Patent No.: US 6,405,383 B2
(45) Date of Patent: Jun. 18, 2002

(54) LEG PROTECTION SYSTEM

(75) Inventors: John F. Heller, Coon Rapids; Gregory B. Fisher, St. Paul, both of MN (US)

(73) Assignee: Outdoor Creations, Inc., Minneapolis, MN (US)

( * ) Notice: Subject to any disclaimer, the term of this patent is extended or adjusted under 35 U.S.C. 154(b) by 0 days.

(21) Appl. No.: 09/809,874

(22) Filed: Mar. 16, 2001

Related U.S. Application Data

(60) Provisional application No. 60/189,939, filed on Mar. 16, 2000.

(51) Int. Cl.[7] ..... A41D 13/00

(52) U.S. Cl. ..... 2/242; 2/22

(58) Field of Search ..... 2/22, 455, 16, 2/69, 24, 79, 2.5, 46, 242, 59, 51, 62, 269; 128/878, 882; 602/23, 26, 62, 63; 36/1.5, 2 R

(56) References Cited

U.S. PATENT DOCUMENTS

| | | | | | |
|---|---|---|---|---|---|
| 909,215 | A | | 1/1909 | Pierce et al. | |
| 2,733,443 | A | | 2/1956 | Holder | 2/22 |
| 4,110,845 | A | | 9/1978 | Chellis | 36/2 R |
| 4,599,812 | A | | 7/1986 | Harmsen | 36/1.5 |
| 4,796,303 | A | | 1/1989 | Atwater | 2/24 |
| 4,893,355 | A | | 1/1990 | Ritter | 2/24 |
| 5,031,247 | A | | 7/1991 | Carter | 2/242 |
| D321,969 | S | | 12/1991 | Upthegrove, Jr. et al. | D2/225 |
| 5,613,250 | A | | 3/1997 | Bell | 2/242 |
| 5,652,956 | A | * | 8/1997 | Hoshizaki et al. | 2/22 |
| 5,662,594 | A | * | 9/1997 | Rosenblatt | 602/16 |
| 5,732,411 | A | | 3/1998 | Coleman et al. | 2/22 |
| 5,774,892 | A | * | 7/1998 | Tisdale et al. | 2/69 |
| 5,794,261 | A | | 8/1998 | Hefling | 2/16 |
| 5,970,525 | A | | 10/1999 | Gallinot et al. | 2/242 |
| 5,987,778 | A | | 11/1999 | Stoner | 36/1.5 |
| 6,173,448 | B1 | | 1/2001 | Kroposky | 2/22 |
| 6,178,555 | B1 | * | 1/2001 | Williams | 2/22 |

FOREIGN PATENT DOCUMENTS

| | | | | |
|---|---|---|---|---|
| CH | 575217 | * | 5/1976 | 2/22 |
| GB | 1 562 191 | * | 3/1980 | |

* cited by examiner

*Primary Examiner*—Gloria M. Hale
*Assistant Examiner*—Tejash Patel
(74) *Attorney, Agent, or Firm*—Kinney & Lange, P.A.

(57) ABSTRACT

A leg protection system selectively covers a person's lower leg and knee for protection against environmental elements. The leg protection system comprises a first protective cover and a second protective cover which are selectively attachable to each other to define a single leg protection system. The first protective cover is adapted to cover the front and side portions of a wearer's knee. The first protective cover has a top portion and a bottom portion, whereby the top and bottom portions are formed of a flexible material for generally fitting the contour of the knee. The bottom portion has a first releasable strap assembly adapted to extend behind the wearer's leg to operatively attach the first protective cover over the knee. The second protective cover is adapted to cover the front and side portions of a wearer's lower leg. The second protective cover is formed of a flexible material for generally fitting the contour of the lower leg. The second protective cover has a second releasable strap assembly adapted to extend behind the wearer's lower leg to operatively attach the second protective cover to the lower leg. The first and second protective covers are selectively attachable adjacent their respective bottom and top edges to define, when so attached, a single leg protective system.

19 Claims, 13 Drawing Sheets

LEG PROTECTION SYSTEM

The application claims priority from U.S. Provisional Application Ser. No. 60/189,939 filed Mar. 16, 2000 for "Garden Chaps" by John Heller and Gregory Fisher.

BACKGROUND OF THE INVENTION

The present invention relates generally to protective apparel for the lower leg and knee, and more specifically to a leg protection system which can be worn over the knee only or worn as a complete leg protection system covering the knee and the lower leg. The cover is universal, in that it may be worn on either the left or right leg individually or on both legs.

There are many occasions when a person's lower legs and knees are exposed to conditions which may cause the person's clothing to become dirty or damaged, prompting a person to wear protective covering. As most homeowners and landscape workers are well aware, many yard and gardening tasks such as grass cutting, weed whacking, leaf blowing, or raking, result in dirt, twigs, leaves, grass cuttings, and other outdoor debris being deposited on the lower legs and knees of the person performing the tasks or possibly staining the person's clothes. In addition, protective covering provides additional padding and comfort to a person who is resting or supporting his or her weight on their legs or knees while performing outdoor tasks as well as indoor tasks, such as laying flooring or cleaning floors.

On other occasions a person's lower legs and knees are exposed to conditions which may cause injury to the person and/or damage to their clothing. Operating a string trimmer is especially hazardous because of the exposed rotating cutting string. The exposed cutting string has been known to occasionally hit the leg of the operator of the string trimmer, thus causing injury to the operator's leg. In addition, protective covering serves to protect the person's legs and clothes during painting or other chemically damaging operations, such as spraying a herbicide or pesticide.

Protective guards designed to protect the leg, knee, or shin are commonly used in sports. Full length protective guards are conventionally used by catchers in softball or baseball where protection of the entire lower leg is important. Other sports such as soccer, which have protective guards for the shin, and volleyball, which have protective padding for the knees, utilize fixed length protective guards for specific regions of the leg. However, such protective guards are generally made of relatively hard, inflexible or bulky material and is not well suited for gardening or other landscaping activities.

Other types of leg protection coverings are widely available which protect the lower leg and the foot in a one piece covering. Examples of this kind of leg protective covering range from U.S. Pat. No. 5,987,778 for protecting a wearer's leg and foot from injury, to U.S. Pat. No. 4,057,853, which discloses snake proof leggings made of steel mesh to cover the lower leg and foot, to U.S. Pat. No. 5,970,525, which describes a leg guard apparatus that covers the leg from above the knee to the foot. However, none of these protective coverings offer a single leg protection system with a selectively attachable knee protective cover and lower leg protective cover, which allows a user the ability to wear a knee protective cover by itself or together with the lower leg protective cover.

BRIEF SUMMARY OF THE INVENTION

A leg protection system for selectively covering a person's lower leg and knee comprising a first protective cover and a second protective cover selectively attachable to each other to define a single leg protection system. The first protective cover is adapted to cover the front and side portions of a wearer's knee. The first protective cover has a top edge, a bottom edge and a pair of lateral edges extending between the top and bottom edges. The first protective cover has a top portion and a bottom portion, whereby the top and bottom portions are formed of a flexible material for generally fitting the contour of the knee. The bottom portion has a first releasable strap assembly adapted to extend behind the wearer's leg to operatively attach the first protective cover over the knee. The second protective cover is adapted to cover the front and side portions of a wearer's lower leg. The second protective cover has a top edge, a bottom edge and a pair of lateral edges extending between the top and bottom edges. The second protective cover is formed of a flexible material for generally fitting the contour of the lower leg. The second protective cover has a second releasable strap assembly adapted to extend behind the wearer's lower leg to operatively attach the second protective cover to the lower leg. The first and second protective covers are selectively attachable adjacent their respective bottom and top edges to define, when so attached, a single leg protective system.

BRIEF DESCRIPTION OF THE DRAWINGS

The present invention will be further explained with reference to the attached figures, wherein like structure is referred to by like numerals throughout the several views.

While the above-identified drawing figures set forth one preferred embodiment of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1:
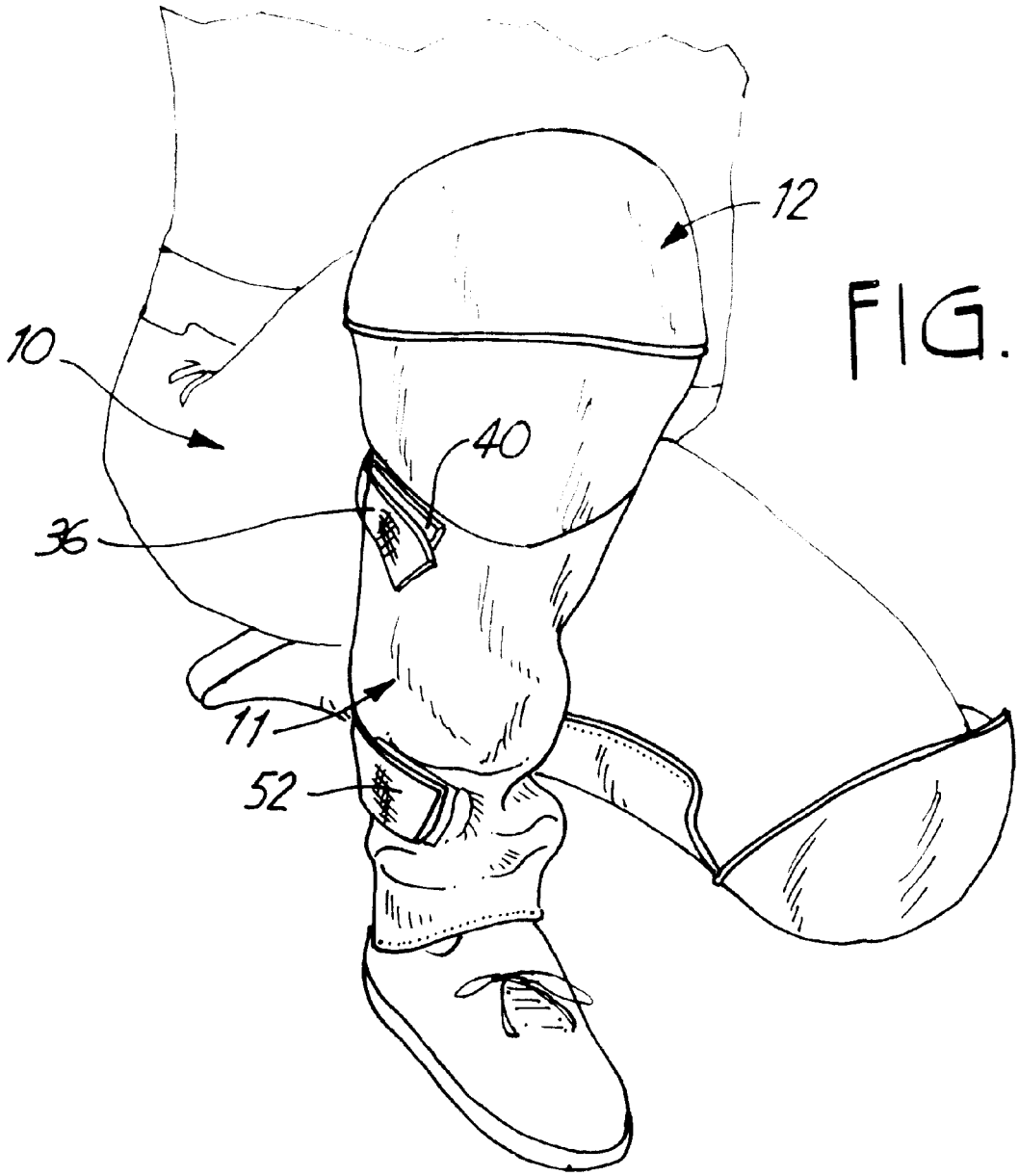
FIG. 1 is a perspective view of the inventive leg protection system on a wearer's leg.

The present invention is a leg protection system shown at 10 in FIG. 1. The leg protection system 10 or chap is adapted to be worn around the wearer's lower leg 11 and knee 12 to protect the user from environmental elements as well as providing the user with comfort while performing outdoor and indoor activities. The leg protection system 10 has sufficient flexibility to be deformable into a generally C-shaped configuration to substantially encircle and cover the front and sides of the wearer's lower leg 11 as well as the front and sides of the wearer's knee 12. The material of the leg protection system 10 is fabricated from vinyl, rubber, foam rubber, polyester, heavy canvas or the like.

Figure 2:
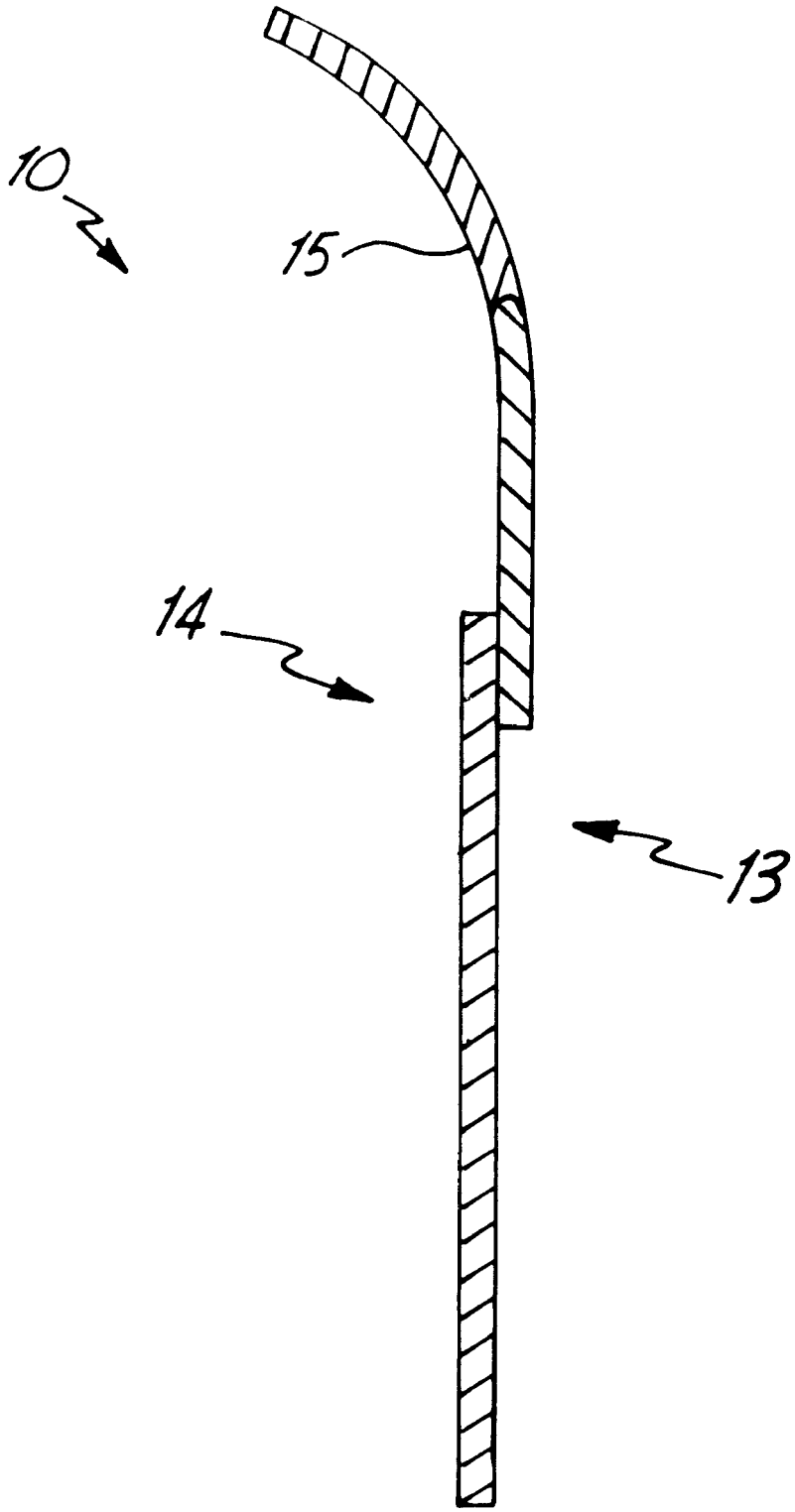
FIG. 2 is a simplified longitudinal cross-sectional view of the inventive leg protection system.

As shown in FIG. 2, the leg protection system 10 has an outer surface 13 which faces the environment and an inner surface 14 which is in contact with the lower leg 11 and knee 12. Preferably, the outer surface 13 is vinyl and is a heavier more rugged protective surface than the inner surface 14. Even more preferably, the outer surface 13 is waterproof. Preferably, a first protective cover 16 has a liner 15 on the inner surface 14 disposed between the first protective cover and the knee 12. Preferably, the liner 15 is polyester to provide a smooth, comfortable, yet durable surface for the knee to articulate against.

Figure 3:
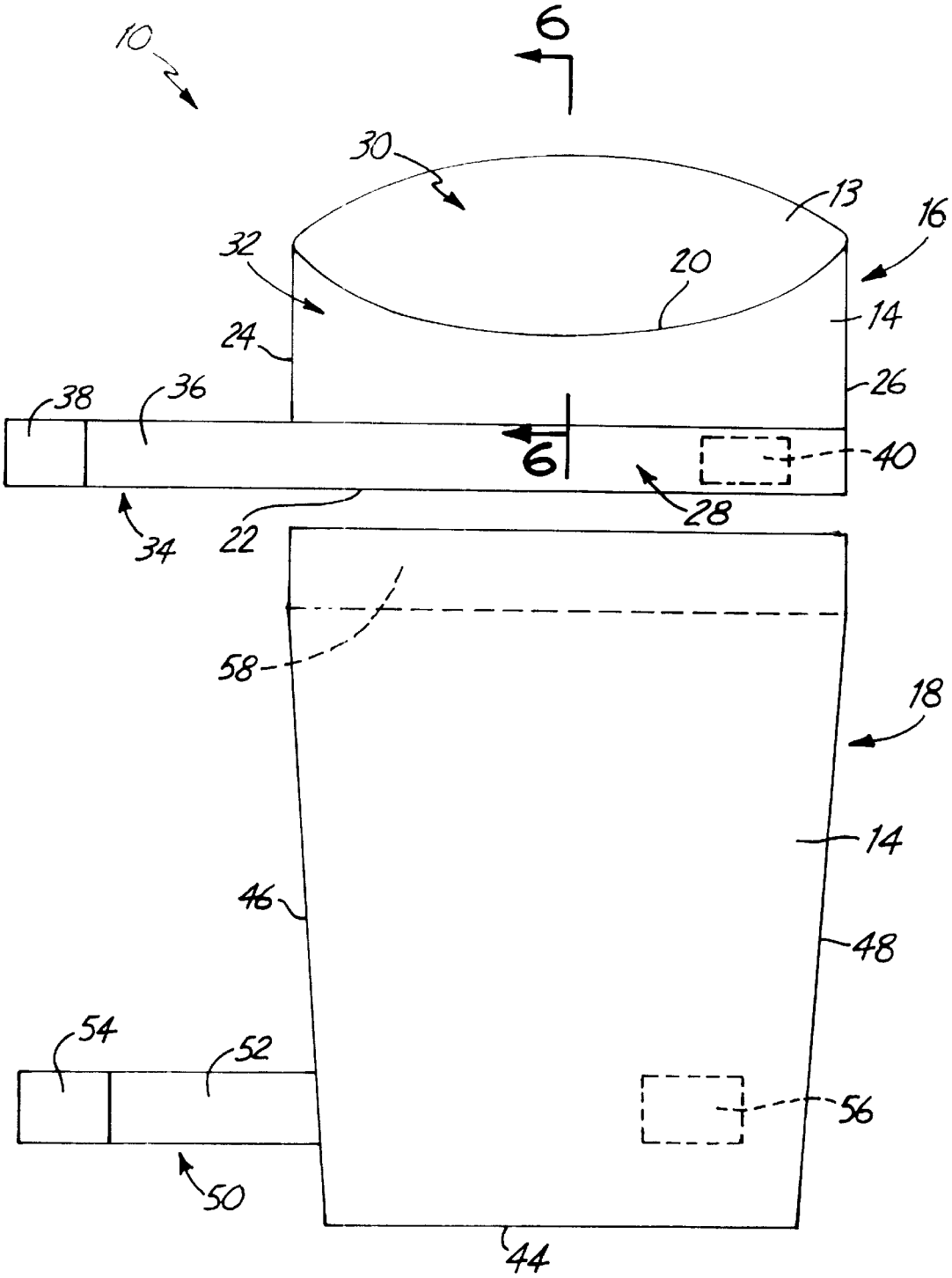
FIG. 3 shows a rear elevational view of the inner surface of the first protective cover and the second protective cover of the inventive leg protection system.

The leg protection system 10, shown in FIG. 3, includes a first protective cover 16 and a second protective cover 18, whereby the first and second protective covers 16, 18 are selectively attachable to one another to form a single leg protection system 10. The first protective cover 16 has a top edge 20, a bottom edge 22, and a pair of lateral edges 24, 26 extending between the top edge 20 and bottom edge 22. The first protective cover 16 has a first fastener 28 for selectively attaching the first protective cover 16 to the second protective cover 18. Preferably, the first fastener 28 is on the inner surface 14 of the first protective cover 16 along the bottom edge 22. As shown in FIG. 3, the first fastener 28 is one portion of a two-part mechanical fastener, such as a strip of hook or loop fastener material. Alternatively, the first fastener 28 could be any type of fastener intended for engagement with the second protective cover 18, including a zipper, a plurality of buttons or snaps, Dual-Lok Fastener, headed stems, etc.

The first protective cover 16 has a upper portion 30 and a lower portion 32. The first protective cover 16 has at least one first strap assembly 34 to operatively attach the first protective cover 16 over the knee 12. In the preferred embodiment, as shown in FIG. 1, the lower portion 32 has a first releasable strap assembly 34 adapted to extend behind the lower leg 11 to operatively attach the first protective cover 16 to the knee 12. The first releasable strap assembly 34 has a strap member 36, which is preferably elastic and secured at one end to the lateral edge 24 of the lower portion 32 at the bottom edge 22. The other end of the strap member 36 has a first patch 38 of a two-part mechanical fastener (such as hook and loop, Dual-Lok, etc.) which cooperates with a second opposed patch 40 of the fastener which is disposed on the opposing lateral edge 26 on the outer surface 13 of the lower portion 32. The first strap assembly 34, extending from the bottom edge 22 of the lower portion 32, offers the advantage of attaching the first protective cover 16 around the lower leg 11, below the knee 12, thereby preventing discomfort typically caused when an attachment strap extends behind the knee when the knee is bent.

As seen in FIG. 3, the second protective cover 18 has a top edge 42, a bottom edge 44, and a pair of lateral edges 46, 48 extending between the top edge 42 and bottom edge 44. The second protective cover 18 is generally elongate, and the top edge 42 and the bottom edge 44 are generally normal relative to the lateral edges 46, 48. Preferably, the second protective cover 18 is wider adjacent the top edge 42 than adjacent the bottom edge 44. As shown in FIG. 3, the top edge 42 of the second protective cover 18 is substantially the same width as the bottom edge 22 of the first protective cover 16. The second protective cover 18 has at least one second releasable strap assembly 50 adapted to extend behind the lower leg 11 to operatively attached the second protective cover 18 to the lower leg 11. Preferably, the second strap assembly 50 is closer in proximity to the bottom edge 44 of the second protective cover 18 than it is to the top edge 42 of the second protective cover 18. The second releasable strap assembly 50 has a strap member 52, which is preferably elastic and secured at one end to the lateral edge 46 of the second protective cover 18. The other end of the strap member 52 has a third patch 54 of a two-part mechanical fastener (such as hook and loop, etc.) which cooperates with a fourth patch 56 of the two-part mechanical fastener which is disposed on the opposing lateral edge 48 on the outer surface 13 of the second protective cover 18. The top edge 42 has a second fastener 58 for selectively attaching the second protective cover 18 to the first fastener 28 of the first protective cover 16. Preferably, the second fastener 58 is on the outer surface 13 of the second protective cover 18 along the top edge 42. As shown in FIG. 3, the second fastener 58 is a strip of a two-part mechanical-type fastener, which cooperatively mates with the first fastener 28 of the first protective cover 16.

Figure 4:
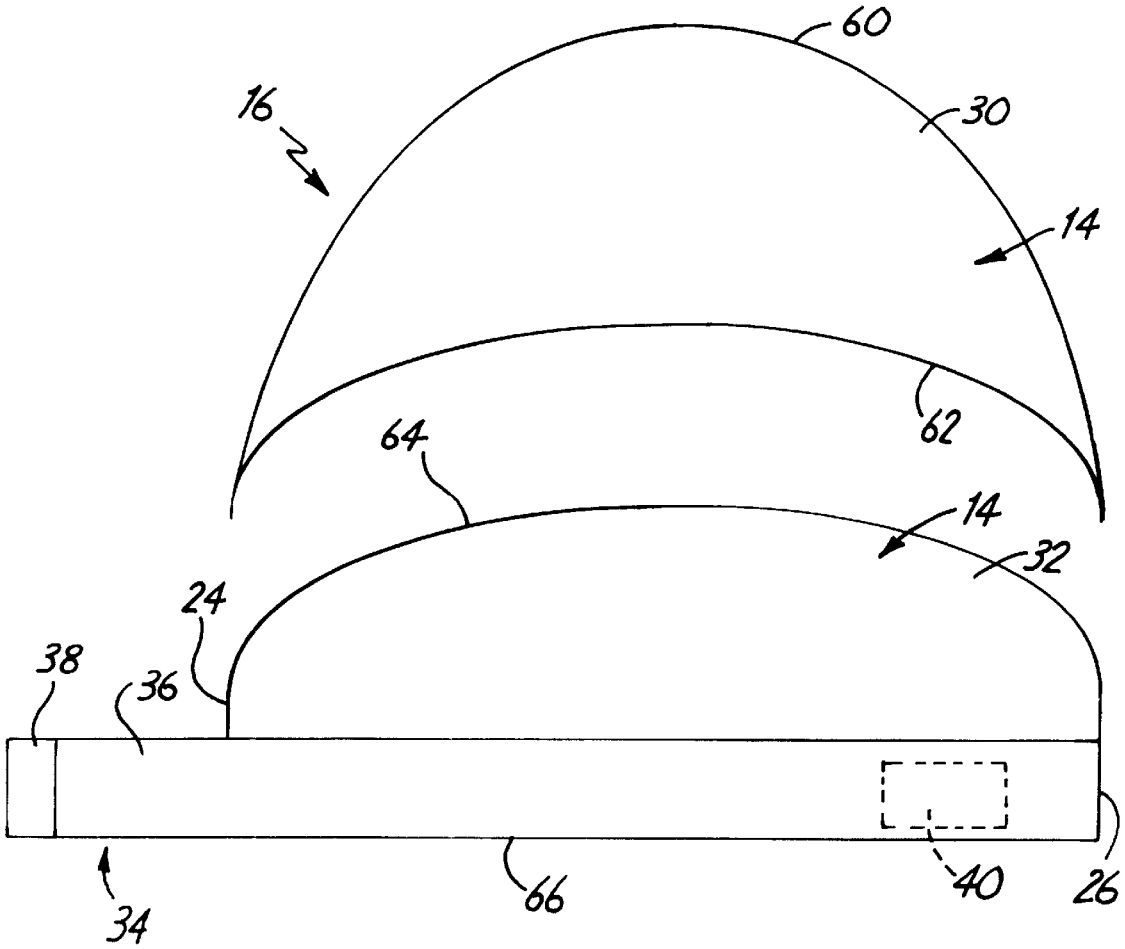
FIG. 4 is an exploded rear view of the inner surface of the upper and lower portions of the first protective cover of the inventive leg protection system.
Figure 5:
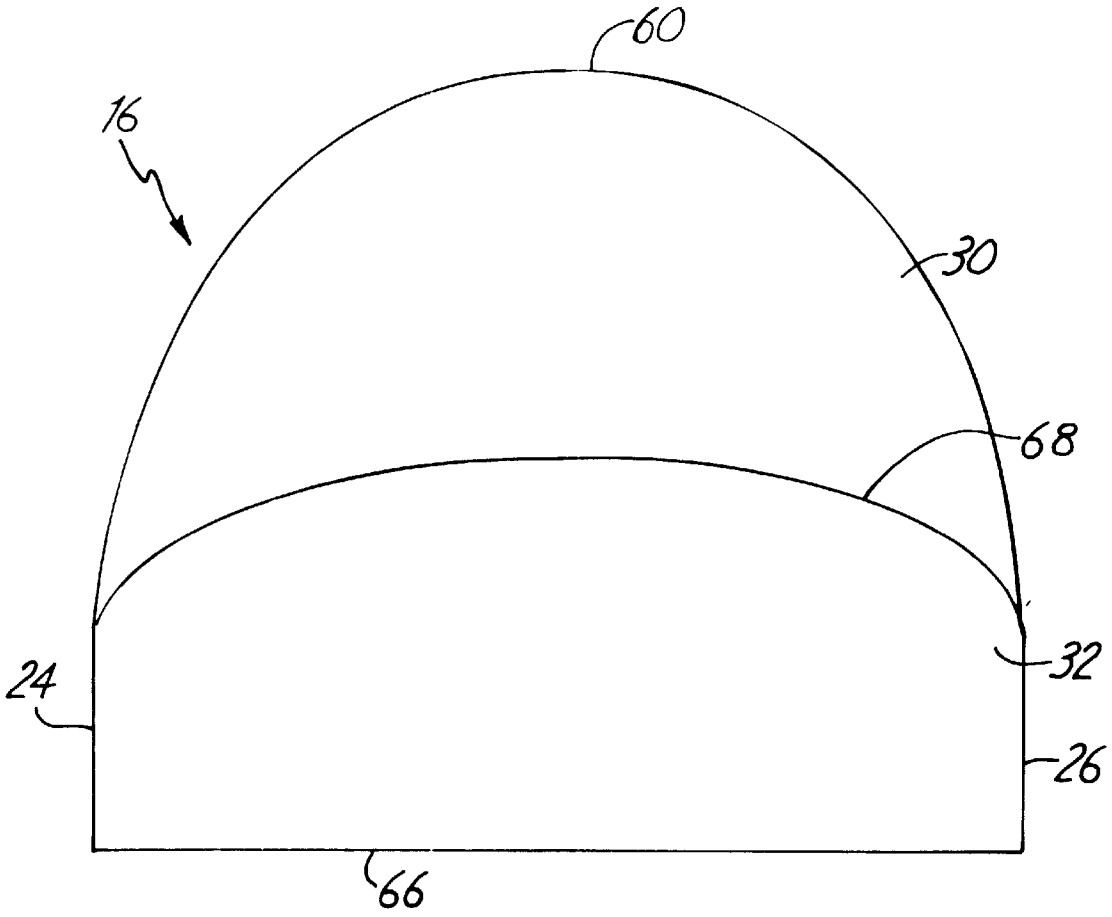
FIG. 5 is a rear view of the inner surface of the upper and lower portions joined together to form the first protective cover of the inventive leg protection system.
Figure 6:
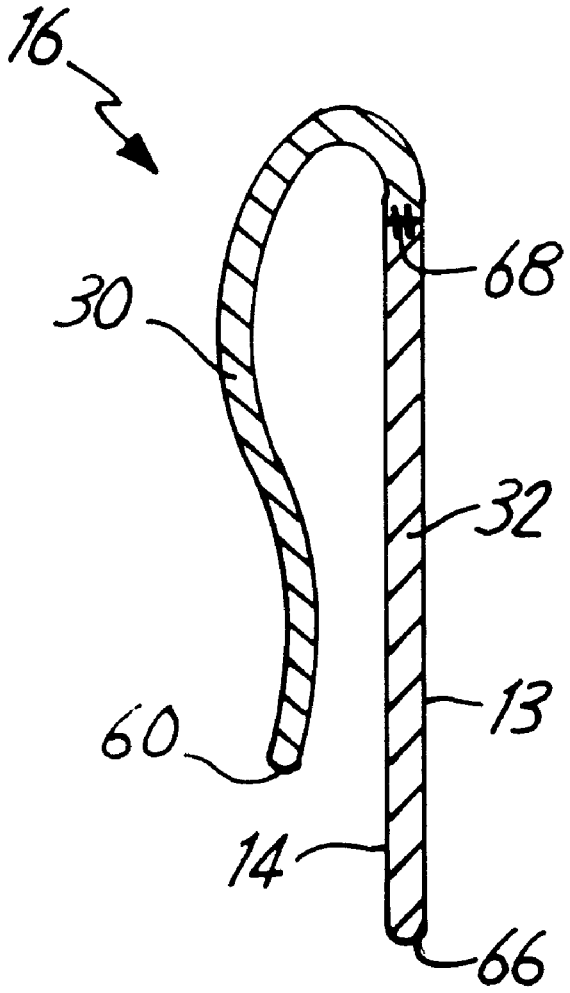
FIG. 6 is a longitudinal cross-sectional view of the first protective cover of the inventive leg protection system in an unworn or relaxed state (as taken along lines 6—6 in FIG. 3).

In the preferred embodiment, the upper portion 30 and the lower portion 32 are joined together, as for example, by stitching. FIG. 4 shows the upper portion 30 and lower portion 32 before being joined together. The upper portion 30 has an upwardly curving top edge 60 and an upwardly curving bottom edge 62. The lower portion 32 has an upwardly curving top edge 64 and a bottom edge 66. The bottom edge 66 is generally normal relative to the lateral edges 24, 26. The curvature of the upwardly curving bottom edge 62 of the upper portion 30 is substantially the same curvature as the upwardly curving top edge 64 of the lower portion 32. The curved bottom edge 62 of the upper portion 30 and the curved top edge 64 of the bottom portion 32 are stitched or otherwise attached together creating an upwardly curving seam 68, as shown in FIG. 5. In its relaxed state (not worn on a user's leg), shown in FIG. 6, the seam 68 causes the upper portion 30 to generally fold over (adjacent the seam 68) onto the inner surface 14 of the lower portion 32 of the first protective cover 16.

Figure 7:
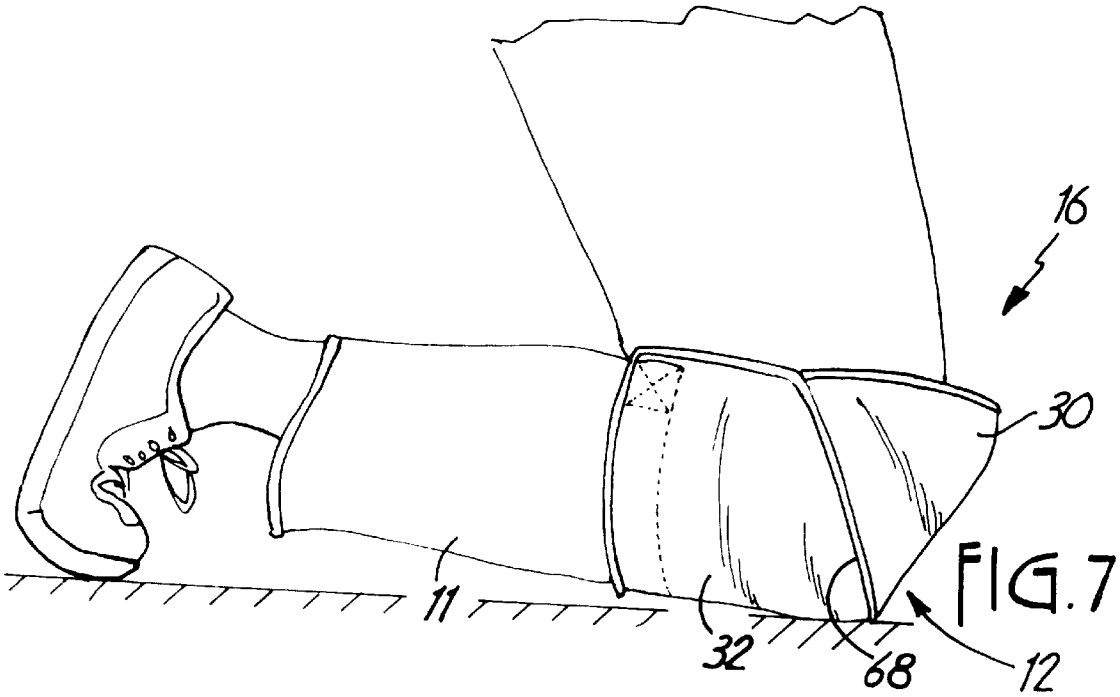
FIG. 7 is a perspective view of the first protective cover of the inventive leg protection system on a wearer's knee.

As shown in FIG. 7, the first protective cover 16 of the leg protection system 10 generally fits the contour of the front and sides of the knee 12 and the adjacent portion of the lower leg 11. As shown in FIG. 7, the first protective cover 16 can be worn without the second protective cover 18.

When the first protective cover 16 is worn on the front of the knee 12, the lateral edges 24, 26 are wrapped around the sides of the knee 12. As the lateral edges 24, 26 are wrapped around the contour of the knee 12, the upper portion 30 flares up and out into an arcuately curved configuration which overlies the front and the sides of the knee 12. The arcing of the seam 68 forms a proper fit over the knee 12 by creating a bend or angle in the first protective cover 16 which allows the first protective cover 16 to follow the natural contour of the knee 12. The bend created by the seam 68 allows the first protective cover 16 to conform to the knee 12 as the knee 12 bends.

Figure 8:
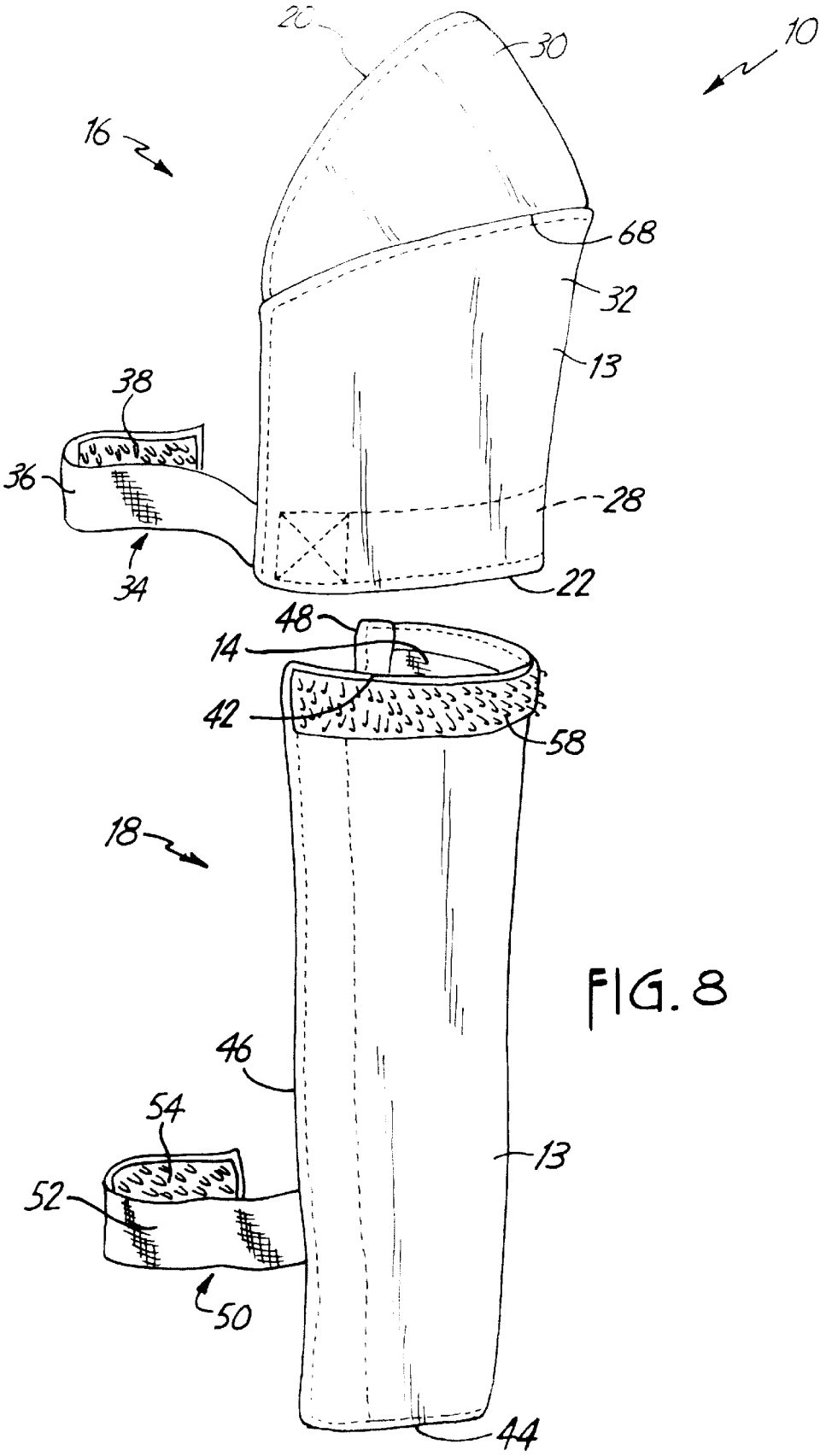
FIG. 8 is a perspective view of the first protective cover unattached to the second protective cover of the inventive leg protection system.
Figure 9:
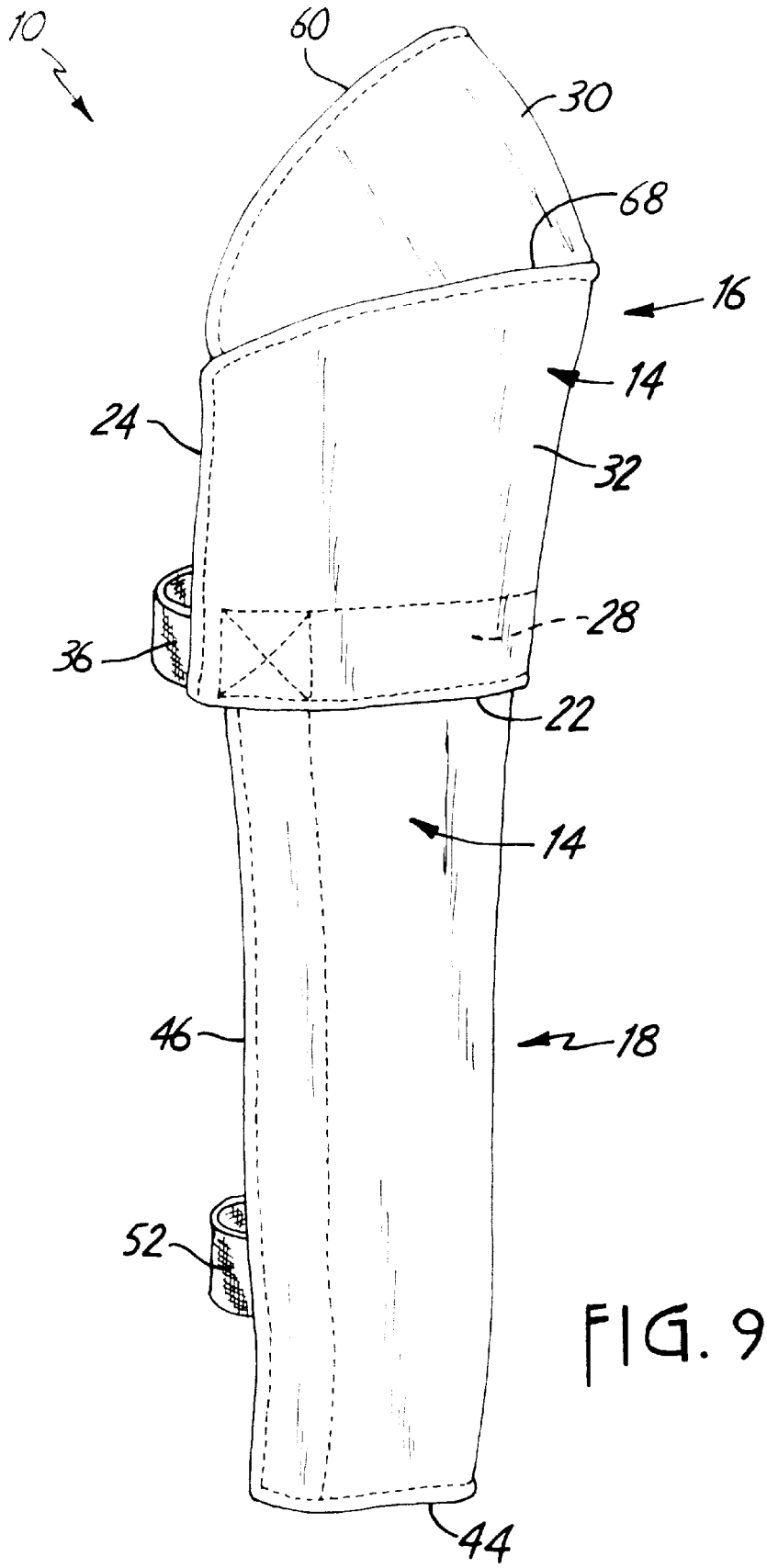
FIG. 9 is a perspective view of the first protective cover selectively attached to the second protective cover to form a single leg protective system.

As shown in FIGS. 8 and 9, the first fastener 28 is selectively attachable to the second fastener 58 to define, when so attached, the single leg protective system 10. Alternatively, the first protective cover 16 is selectively detachable from the second protective cover 18, whereby the user has the option of wearing only the first protective cover 16, or only the second protective cover 18.

Figure 10:
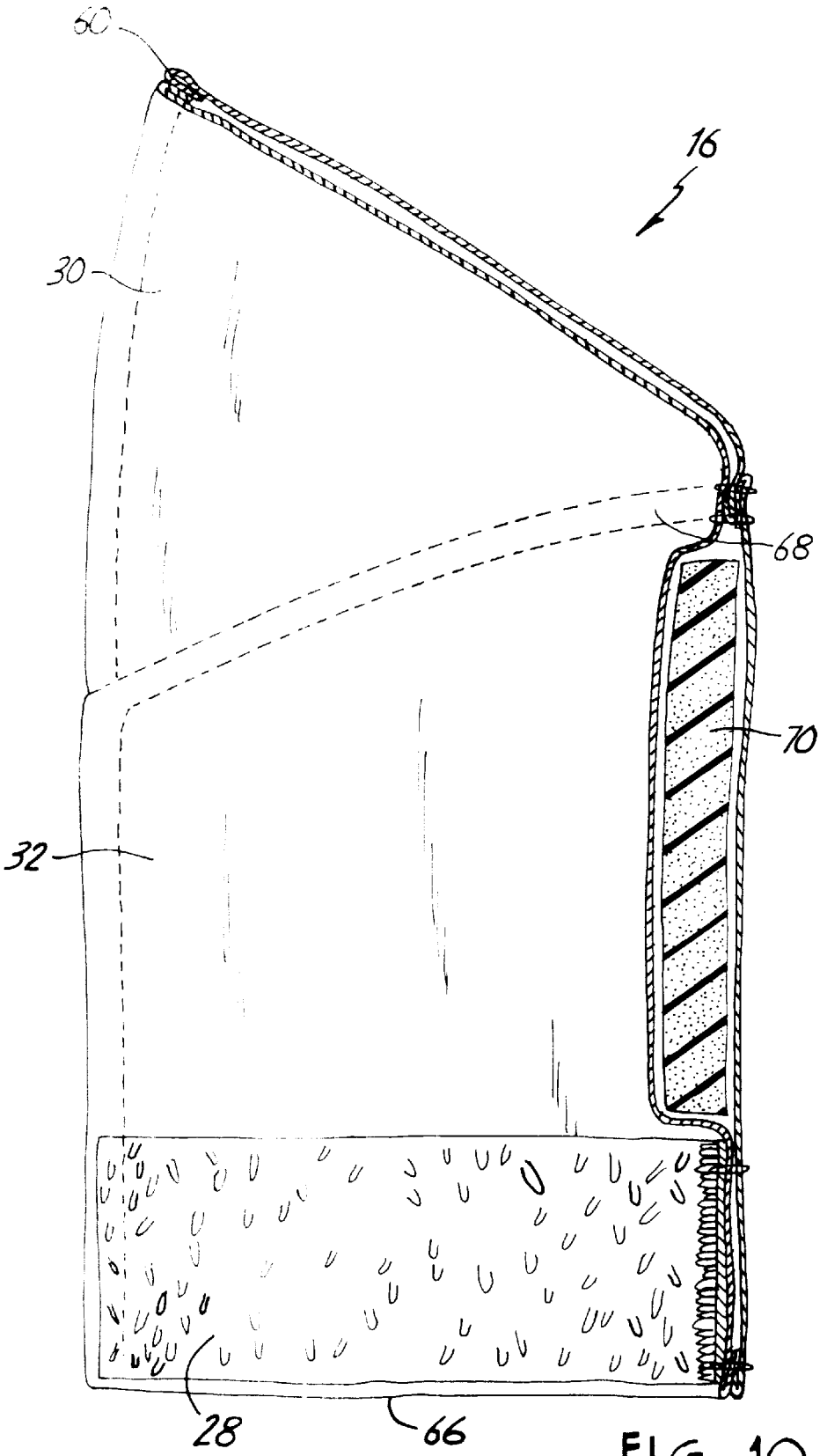
FIG. 10 is a cross-sectional view of the first protective cover of the inventive leg protection system in a worn or arcing configuration.
Figure 11:
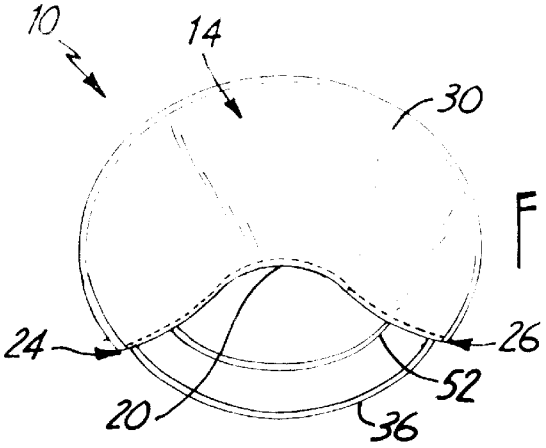
FIG. 11 is a top orthogonal view of the leg protection system of FIG. 9.
Figure 12:
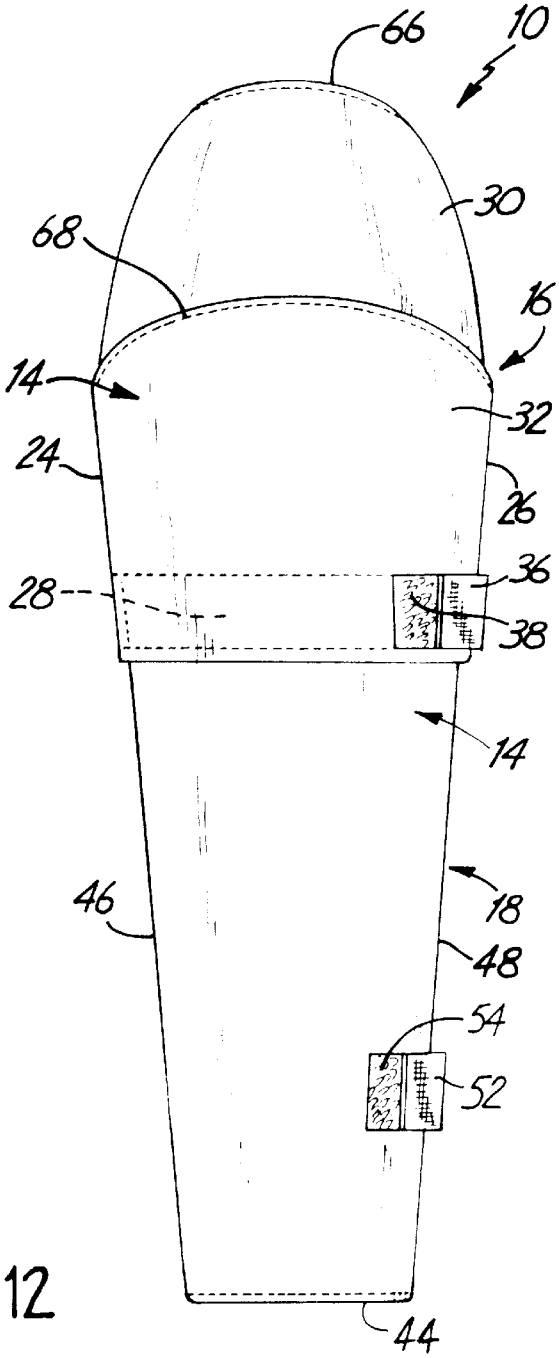
FIG. 12 is a front orthogonal view of the leg protection system of FIG. 9.
Figure 13:
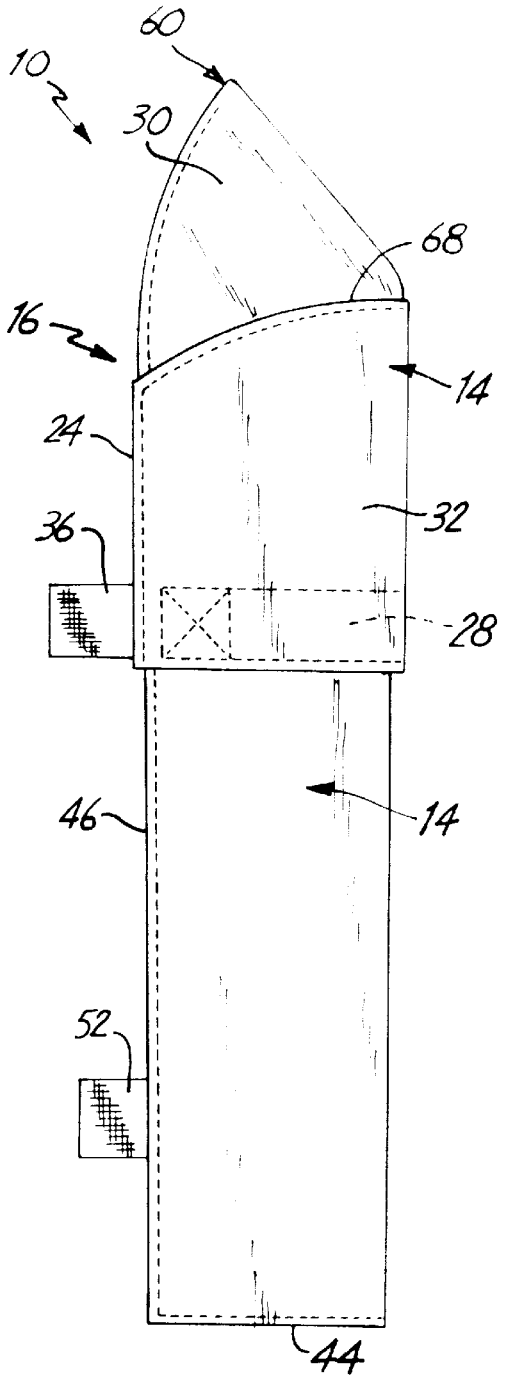
FIG. 13 is a side orthogonal view of the leg protection system of FIG. 9.
Figure 14:
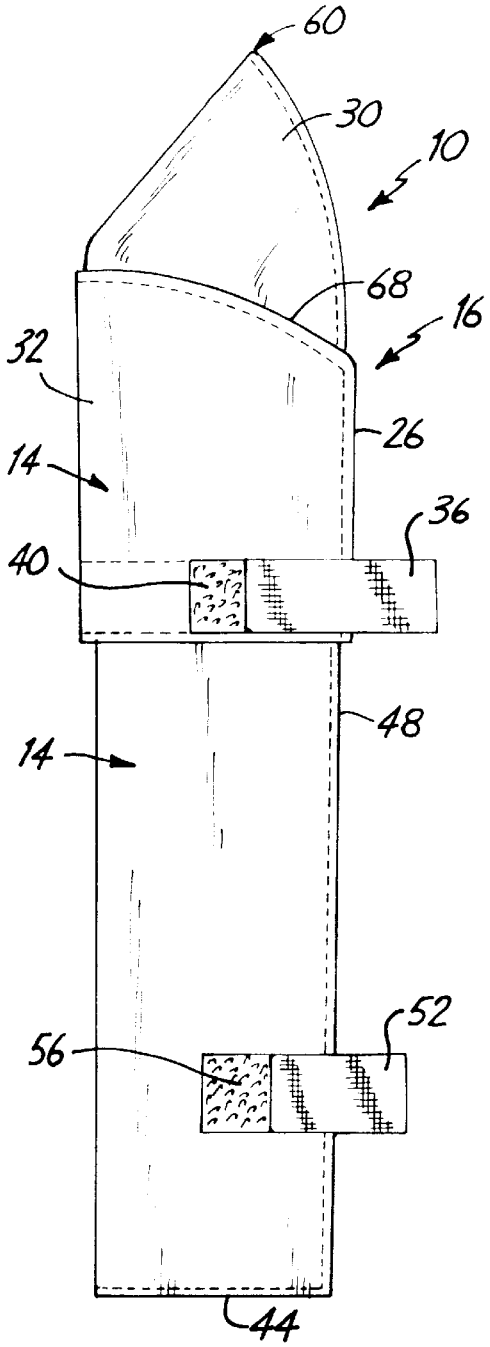
FIG. 14 is a side orthogonal view of the leg protection system of FIG. 9.
Figure 15:
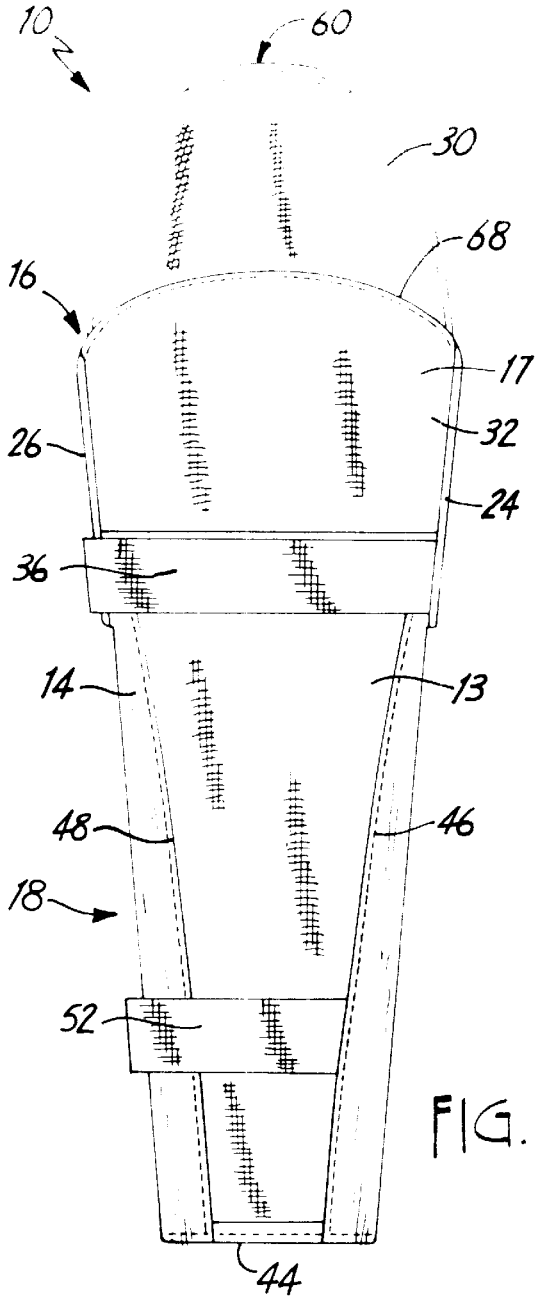
FIG. 15 is a rear orthogonal view of the leg protection system of FIG. 9.
Figure 16:
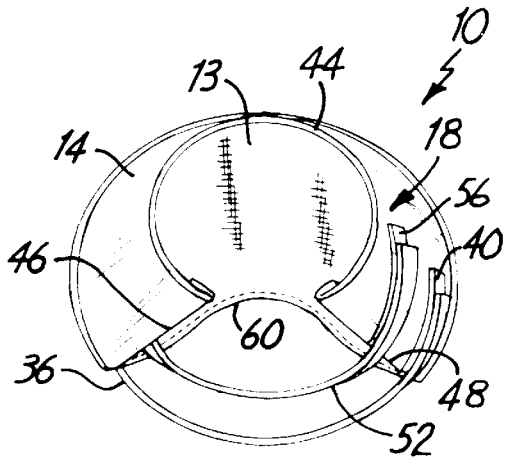
FIG. 16 is a bottom orthogonal view of the leg protection system of FIG. 9.

As shown in FIG. 10, the lower portion 32 of the first protective cover includes an elastomeric pad 70, such as a foam pad, to provide additional cushioning for the knee. This is especially useful when the user is kneeling or crouching on the ground and supporting his or her weight on one or both knees.

FIGS. 1, 2 and 7 show assembled views of the present invention, whereas FIGS. 11–16 show the present invention in various orthogonal views.

The present invention is a flexible and protective layer to fit the contour of the lower leg and knee providing protection while performing landscaping, gardening, or even indoor construction or repair. The outer surface of the leg protection system is tough, resilient and capable of withstanding harsh environmental conditions. In addition, the outer surface is waterproof keeping a person's lower leg and knee dry, as well as allowing a person to easily clean dirt and debris from the outer surface. The inner surface has a liner for a smooth surface, as well as padding around the knee providing comfort and support. The present invention also provides the option to wear the present invention as a single leg protection system covering the lower leg and knee or to selectively detach the first protective cover from the leg protection system and wear only the first protective cover over the knee.

Although the present invention has been described with reference to preferred embodiments, workers skilled in the art will recognize that changes may be made in form and detail without departing from the spirit and scope of the invention.

What is claimed is:

1. A leg protection system for selectively covering a person's lower leg and knee comprising:

a first protective cover adapted to cover front and side portions of a wearer's knee, the first protective cover having a top edge, a bottom edge and a pair of lateral edges extending between the top and bottom edges, the first protective cover having a top portion and a bottom portion, the top and bottom portions being formed of a flexible material for generally fitting the contour of the knee, and the bottom portion having a first releasable strap assembly adapted to extend behind the wearer's leg to operatively attach the first protective cover over the knee; and a second protective cover adapted to cover front and side portions of a wearer's lower leg, the second protective cover having a top edge, a bottom edge and a pair of lateral edges extending between the top and bottom edges, the second protective cover being generally elongate, the second protective cover being formed of a flexible material for generally fitting the contour of the lower leg, the second protective cover having a second releasable strap assembly adapted to extend behind the wearer's lower leg to operatively attach the second protective cover to the lower leg, and the first and second protective covers being selectively attachable adjacent their respective bottom and top edges to define, when so attached, a single leg protective system.

2. A leg protector according to claim 1, wherein the top edge of the first protective cover is curved between the lateral edges, and the bottom edge of the first protective cover extends generally normal between the lateral edges.

3. A leg protector according to claim 1, wherein the top and bottom edges of the second protective cover extend generally normally relative to the lateral edges and the second protective cover is wider adjacent the top edge thereof than adjacent the bottom edge thereof.

4. A leg protector according to claim 1, wherein the top portion has a upwardly curving bottom edge and the bottom portion has an upwardly curving top edge, wherein the curvature of the bottom edge of the top portion is substantially identical to the curvature of the top edge of the bottom portion, and the bottom edge of the top portion is attachable to the top edge of the bottom portion to define a fold in the first protective cover allowing the first protective cover to bend as the knee bends.

5. A leg protector according to claim 4, wherein the bottom edge of the top portion is sewn to the top edge of the bottom portion.

6. A leg protector according to claim 4, wherein when the first protective cover is operatively attached over a wearer's knee, the lateral edges of the first protective cover are wrapped around the sides of the knee thereby covering the front of the knee and the fold causes the upper portion to flare up and out into an arcuately curved configuration covering the contour of the knee.

7. A leg protector according to claim 1, wherein the first and second protective covers are selectively attached together by two-part mechanical fasteners on opposed facing portions thereof.

8. A leg protector according to claim 7, wherein the two-part mechanical fasteners are hook and loop fasteners.

9. A leg protector according to claim 1, wherein the first strap assembly has a strap extending from one lateral edge of the bottom portion at the bottom edge for fastening around the wearer's lower leg.

10. A leg protector according to claim 9, wherein the strap is elastic.

11. A leg protector according to claim 9, wherein a free end of the strap has one portion of a two-part mechanical fastener thereon which cooperates with a second mating portion of the two-part mechanical fastener which is disposed adjacent the opposite lateral edge of the bottom portion.

12. A leg protector according to claim 11, wherein the two-part mechanical fastener is a hook and loop fastener.

13. A leg protector according to claim 1, wherein the second strap assembly is closer to the bottom edge of the second protective cover than to the top edge of the second protective cover.

14. A leg protector according to claim 1, wherein the second strap assembly has a strap extending from one lateral edge of the second protective cover for fastening around the wearer's leg.

15. A leg protector according to claim 14, wherein the strap is elastic.

16. A leg protector according to claim 14, wherein a free end of the strap has one portion of a two-part mechanical fastener thereon which cooperates with a second mating portion of the two-part mechanical fastener which is disposed adjacent the opposite lateral edge of the second protective cover.

17. A leg protector according to claim 16, wherein the two-part mechanical fastener is a hook and loop fastener.

18. A leg protector according to claim 1, wherein the first protective cover has a liner disposed between the first protective cover and the wearer's knee to provide a comfortable and smooth surface for the knee.

19. A leg protector according to claim 1, wherein the leg protecting system is formed from waterproof material.

* * * * *